US006902041B2

(12) United States Patent
Eccleston

(10) Patent No.: US 6,902,041 B2
(45) Date of Patent: Jun. 7, 2005

(54) METHOD AND SYSTEM TO SELECT ELEVATOR FLOORS USING A SINGLE CONTROL

(76) Inventor: Jon E. Eccleston, 88 Los Cerros Ave., Walnut Creek, CA (US) 94598

( * ) Notice: Subject to any disclaimer, the term of this patent is extended or adjusted under 35 U.S.C. 154(b) by 189 days.

(21) Appl. No.: 10/448,486

(22) Filed: May 30, 2003

(65) Prior Publication Data

US 2004/0000453 A1 Jan. 1, 2004

Related U.S. Application Data

(60) Provisional application No. 60/392,233, filed on Jun. 27, 2002.

(51) Int. Cl.[7] ..... B66B 1/16

(52) U.S. Cl. ..... 187/380; 391/395; 391/901

(58) Field of Search ..... 187/380, 381, 187/384, 388, 391–399, 901; 340/502, 505, 539.11, 539.18, 286.11, 7.1

(56) References Cited

U.S. PATENT DOCUMENTS 4,032,882 A * 6/1977 Mandel et al. ..... 187/398
4,678,062 A * 7/1987 Sumka ..... 187/401
5,192,836 A * 3/1993 Schroder ..... 187/384
5,878,530 A 3/1999 Eccleston
6,105,729 A * 8/2000 Nakamori et al. ..... 187/391
6,152,265 A * 11/2000 Bittar et al. ..... 187/384
6,696,926 B2 * 2/2004 Tsukamoto et al. ..... 340/407.1

FOREIGN PATENT DOCUMENTS

JP 04112174 A * 4/1992 ..... B66B/3/00
JP 04159981 A * 6/1992 ..... B66B/1/14
JP 04169478 A * 6/1992 ..... B66B/1/14
JP 06001549 A * 1/1994 ..... B66B/3/00

OTHER PUBLICATIONS

Bartholomew, Edward, *Making the Right Choice*, TeamRehab Report, May 1995, pp. 32–38.

* cited by examiner

*Primary Examiner*—Jonathan Salata

(57) ABSTRACT

A system enables a handicapped person to select a destination floor in an elevator using a single control and comprises a first mechanism to sequentially enumerate potential destination floors, a second mechanism enabling user selection of a desired destination floor by interacting with the single control when the desired destination floor is enumerated by the first mechanism, and a third mechanism to coupled a signal from the second mechanism to command the elevator to halt at the user-selected designation floor. The system may be disposed within and/or without the elevator.

17 Claims, 2 Drawing Sheets

METHOD AND SYSTEM TO SELECT ELEVATOR FLOORS USING A SINGLE CONTROL

RELATION TO PENDING APPLICATION

Priority is claimed to U.S. provisional patent application Ser. No. 60/392,233 filed by applicant herein on Jun. 27, 2002, and entitled "Method and System to Select Elevator Floors Using a Single Control".

FIELD OF THE INVENTION

The present invention relates generally to systems that aid the handicapped, and more particularly to a system enabling handicapped persons to more easily make floor selections in a common elevator.

BACKGROUND OF THE INVENTION

Many handicapped people are challenged to accomplish everyday tasks that non-handicapped people take for granted, and systems and mechanisms are known in the art to help the handicapped. For example, U.S. Pat. No. 5,878,530 to Eccleston (1999) entitled "Remotely Controllable Automatic Door Operator . . . "provides a system to help the handicapped open and close room doors.

Modern wheelchairs have improved mobility for many handicapped people. However after a wheelchair bound person has entered a public building, it can be very challenging for such persons to make elevator floor selections.

For many wheelchair bound individuals, the control buttons for many elevators are located too far above floor level to be easily reached, thus making it difficult for such individuals to select a floor by pressing an elevator control button. Some wheelchair bound individuals may not have the use of their hands and consequently will control their wheelchair with a specialized system. Some such systems are controlled by positions of the handicapped person's head, or by a straw mechanisms through which the handicapped persons blows and sucks air.

Even if the elevator control buttons are within reach, many handicapped individuals lack sufficient hand motor skills to press the desired button to select a floor. For example, a person, wheelchair bound or otherwise, with a severe hand palsy may lack to the ability to press a single small button that is one of many buttons on the elevator control panel. In practice, it is not uncommon for a wheelchair bound person to wait, often for an extended period of time, until a non-handicapped person can be asked to assist in pressing the elevator control button.

In short, there is a need for a system to enable handicapped individuals, including wheelchair bound individuals, to more easily select floors for an elevator without assistance from others. Such system should be universally accessible and controllable by any wheelchair bound person as long as that person can control their wheelchair. Preferably such system should provide user selection of floors using a single control, which control should be actuatable by contact with a portion of a wheelchair and/or another object under the control of a user, including a portion of a user's body. Such system should provide universal access in that the handicapped person should not require special skills or equipment to make use of such system. Such system should provide for visual and/or audible choices for the floor selections that are available. Preferably such system should be useable from inside an elevator and/or from outside the elevator, e.g., adjacent the elevator entrance.

The present invention provides such a system.

DESCRIPTION OF THE PREFERRED EMBODIMENTS

Figure 1:
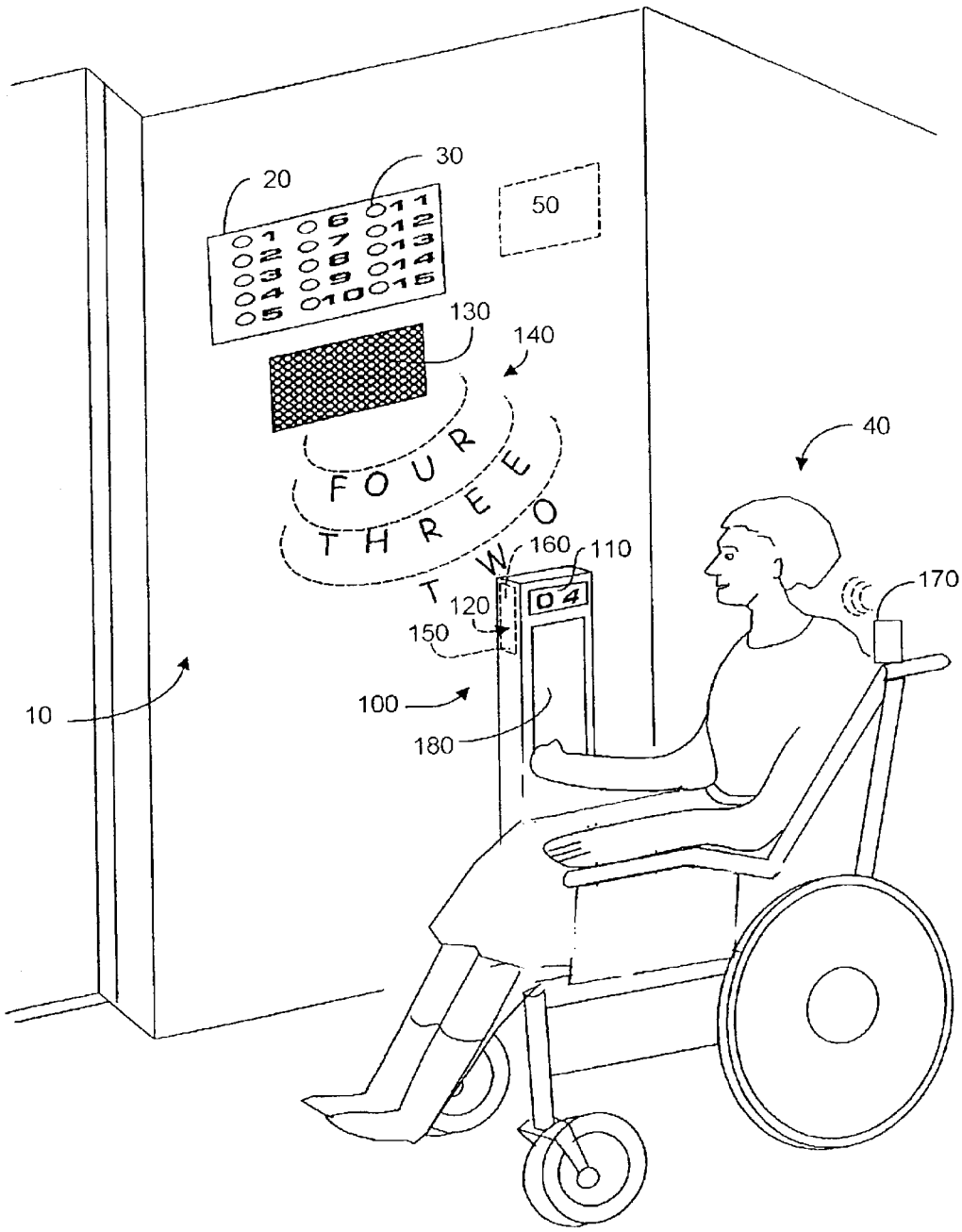
FIG. 1 depicts a generic elevator with a control mechanism, mountable within an elevator and/or outside an elevator, according to one embodiment of the present invention.

FIG. 1 depicts the interior of a conventional elevator 10 that has a control panel 20 of typically small and closely spaced buttons 30 that a passenger must press to select a destination floor. It will be appreciated that what is depicted in FIG. 1 might also be the exterior of a conventional elevator 10, e.g., adjacent the entrance door to the elevator. With respect to control panel 20, a given button 30 may be less than 1 inch$^2$ in area. However a wheelchair bound passenger 40 may not be able to reach any of buttons 30 as they are often placed at a height convenient for standing passengers and thus too high for seated persons. Many wheelchair bound passengers have limited use of their hands and must use their hands to control their wheelchairs, and thus cannot activate tiny elevator buttons even if the buttons were within reach. Also, even a non-wheelchair bound passenger who suffers from hand palsy or other hand motor skill deficit may find it difficult to press one button 30 from the group of buttons on panel 20.

In general, when a passenger selects a floor by pressing a button 30, control electrons 50 associated with elevator 10 causes the elevator to stop at floors so selected. Further, control electronics 50 can illuminate selected buttons 30 or present another display to confirm floor numbers that have been selected by passengers.

In FIG. 1, elevator 10 is shown equipped with a system 100 according to the present invention. Again it is noted that system 100 may be disposed within the elevator and/or external to the elevator, e.g., adjacent the entrance door to the elevator. System 100 includes a display 110 that preferably continually sequentially shows the floors at which elevator 10 can stop, for example "1", then "2", then "3", etc., then repeating, preferably from highest floor to lowest floor. For elevators that service a great many floors, perhaps more than 20, display 110 can first sequence the tens digits, e.g., "0", "1", "2" and then sequence the units digits, e.g., "0", "1", "2", . . . "9".

The continuous sequential display 110 of available floors preferably occurs under control of electronics 120 associated with system 100. In addition to visually signaling potential floor selections, electronics 120 can via speaker 130 also (or instead) acoustically generate acoustic signals 140 announcing potential floor selections. In this regard, electronics 110 can include a voice synthesizer 150 (see FIG. 2) or the like to annunciate the sequence of floor selection numbers. Understandably the annunciated floor selection signals 140 may be annoying to other passengers, whereas the electronically displayed signals 110 are silent. As noted below, annunciated signals can be deferred until system 100 actually detects the presence of a person requiring system 100, for example by briefly contacting touch control 180, which is described below.

At the risk of making system 100 somewhat less universal, if desired electronics 120 could include a low power wireless transmitter 160 that could broadcast the annunciated floor selection signals to a receiver 170 close to the handicapped person's ear. In such embodiment, speaker 130 can be omitted as the annunciated signals would be generated by receiver 170 such that only a person very close to the receiver would hear the spoken signals. Transmitter 160 could be a low power RF transmitter perhaps operating at a frequency within the receiving frequency range of an ordinary transistor receiver 170, e.g., perhaps 1600 KHz. Alternatively, transmitter 160 could be an IR unit, a sub-sonic transmitter, a super-sonic transmitter, in which case receiver 170 would be selected to receive such transmissions.

System 100 includes a preferably large touch control 180 that preferably is sized and positioned for easy contact by a portion of a handicapped passenger's wheelchair. Of course touch control 180 may also be contacted by a portion of a handicapped person's body, e.g., a hand, an elbow, etc. In a preferred embodiment, when touch control 180 is contacted, the currently displayed or annunciated floor selection is "frozen" within electronics 120, thus indicating a desired floor selection. If multiple digits are sequenced, e.g., "tens", "units", the remaining digit will now sequence to be frozen when panel 180 is again contacted. Once digit(s) selection occurs, electronics 140, which also can control the sequential display 110, couples the floor selection electronically to elevator control electronics 50, which will cause elevator 10 to stop at the selected floor.

Touch control 180 may be 24" in height and perhaps 6" in width, a total area of perhaps 144 inch$^2$, which area makes the touch control an easy "target" for a wheelchair. Clearly such a large touch control is easier for a handicapped person to interface with than a tiny, often inaccessibly high elevator button 30. Of course other dimensions may be used for touch control 180, however the suggested dimensions enable the control to be readily contacted by a portion of a wheelchair. Although more than one touch control 180 may be disposed within (and/or adjacent an external portion of) elevator 10, the placement of too many controls 180 increase the likelihood of inadvertent floor selection by an elevator passenger simply bumping into the control.

Touch control 180 may be implemented in various ways, for example by coupling to a mechanical switch. Without limitation, touch control 180 may instead include a piezo-electric region that senses pressure, and/or may include a capacitive region that responds to physical proximity of an object, e.g., a contacting wheelchair portion, a portion of a user's body, etc.

As noted, system 100 typically will be installed within an elevator, but may also (or even instead) be installed externally to the elevator, for example adjacent the elevator door. From the standpoint of the owner of the building in which the elevator is located, it is less expensive to install a single system 100 within an elevator than to install a separate system 100 at each floor in the building at which the elevator stops.

Figure 2:
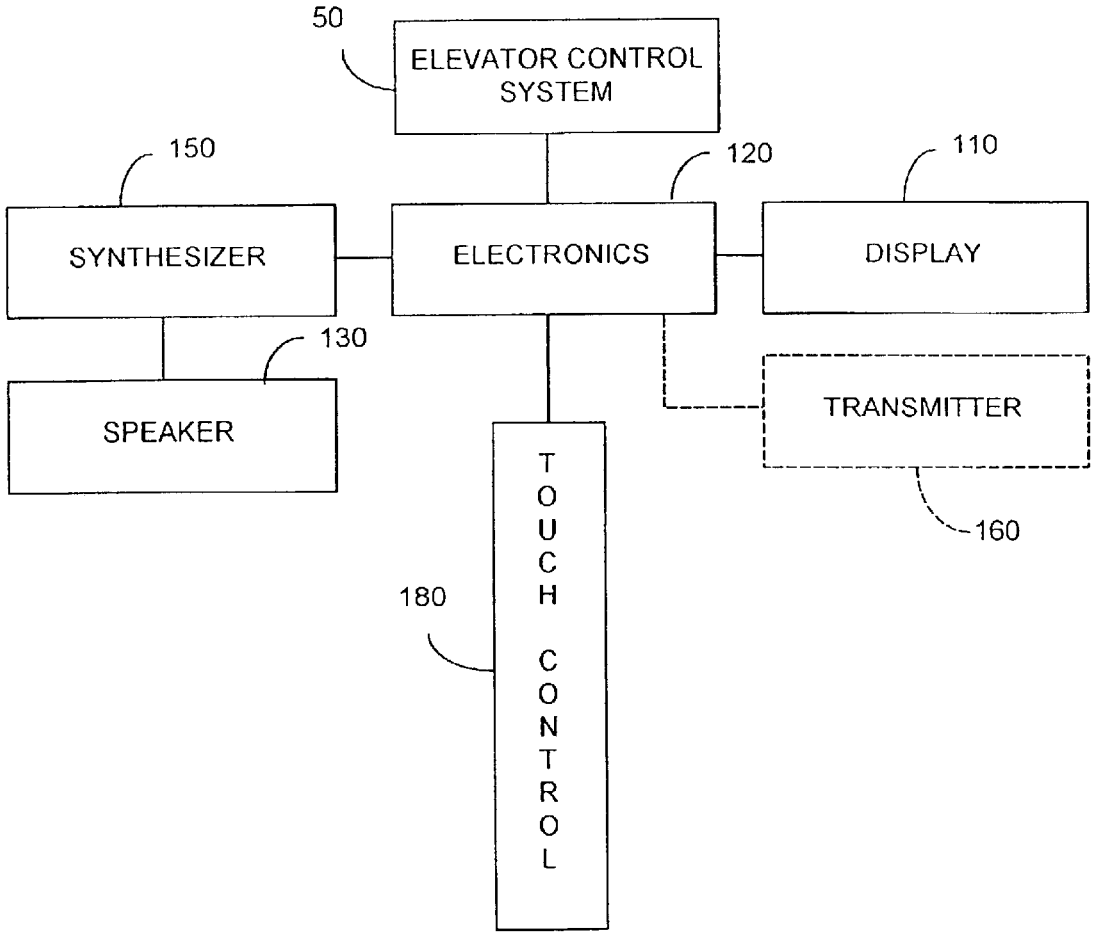
FIG. 2 is a block diagram of the system shown in FIG. 1, according to the present invention.

FIG. 2 is a simplified block diagram of system 100 and will be self-explanatory in view of the above description. Although system 100 can be implemented primarily electronically, one could instead provide the sequential listing of potential destination floors mechanically. For example a large disk, perhaps 15" diameter, could have floor numbers printed near the outer periphery, with one number visible at a time through a viewing window, perhaps similar to that shown for display 110 in FIG. 1. The disk could be made to rotate mechanically until a user-selection is detected via control 180, at which time the number currently viewable would be communicated to the elevator control system 50. If desired, regions of the disk could be encoded such that for each number there is a unique encoding pattern of holes, perhaps BCD encoding, not visible to passengers. However the hole pattern corresponding to the numbers displayed when the user-selection is detected could be detected, e.g., with a photo-diode and photo-detector, and thus signaled to the elevator control system 50.

In summary, the present invention can provide universal access for wheelchair bound persons to select a destination floor in an elevator without use of the hand. The invention need not require special skills by the handicapped (or other) passenger, and in the broadest sense does not require that the handicapped passenger carry special equipment to work with the present invention.

Modifications and variations may be made to the disclosed embodiments without departing from the subject and spirit of the invention as defined by the following claims.

What is claimed is:

1. A method enabling a handicapped person to select a destination floor in an elevator using a single control, the method comprising the following steps:

(A) sequentially enumerating potential destination floors to enable user selection of a chosen said destination floor;

(B) enabling user selection of a chosen said destination floor by interaction with said single control when said destination floor is enumerated at step (A); and (C) commanding said elevator to halt at a floor chosen by a user at step (B).

2. The method of claim 1, wherein at step (A) sequentially enumerating includes sequentially displaying numbers representing said potential destination floors.

3. The method of claim 1, wherein at step (A) sequentially enumerating includes sequentially annunciating numbers representing said potential destination floors.

4. The method of claim 1, wherein at step (A) sequentially enumerating includes wirelessly transmitting numbers representing said potential destination floors to a receiver within earshot of said handicapped person.

5. The method of claim 1, wherein step (B) includes providing a single control selected from a group consisting of (I) a touch plate mechanical switch, (ii) a touch plate piezo-electric control, and (iii) a touch plate with a capacitive region responsive to proximity of an object under control of said handicapped person.

6. The method of claim 1 wherein step (C) includes coupling user selection made at step (B) to a control system of said elevator.

7. A system to enable a handicapped person to select a destination floor in an elevator using a single control, the system comprising:

means for sequentially enumerating potential destination floors to enable user selection of a chosen said destination floor;

means for enabling user selection of a chosen said destination floor by interaction with said single control when said destination floor is enumerated by said means for sequentially enumerating; and means for coupling a signal from said means for enabling to command said elevator to halt at a floor chosen by a user.

8. The system of claim 7, wherein said means for sequentially enumerating includes sequentially displaying numbers representing said potential destination floors.

9. The system of claim 7, wherein said means for sequentially enumerating includes an electronic circuit to display numbers representing said potential destination floors.

10. The system of claim 7, wherein said means for sequentially enumerating includes sequentially annunciating numbers representing said potential destination floors.

11. The system of claim 7, wherein said means for sequentially enumerating includes a circuit to annunciate sequential numbers representing said potential destination floors.

12. The system of claim 1, wherein said system includes a transmitter to wirelessly transmit numbers representing said potential destination floors, and a receiver within earshot of said handicapped person.

13. The system of claim 7, wherein said single control is selected from a group consisting of (I) a touch plate mechanical switch, (ii) a touch plate piezo-electric control, and (iii) a touch plate with a capacitive region responsive to proximity of an object under control of said handicapped person.

14. The system of claim 7, further including a circuit coupling a user selection to a control system associated with said elevator.

15. The system of claim 7, wherein said system is installed within said elevator.

16. The system of claim 7, wherein said system is installed externally to an entrance to said elevator.

17. The system of claim 7, wherein said system is installed within said elevator and also is installed externally to an entrance to said elevator.

* * * * *